US008434944B2

(12) United States Patent
Bois et al.

(10) Patent No.: US 8,434,944 B2
(45) Date of Patent: May 7, 2013

(54) SACHET WITH A CURSOR PROVIDED WITH A JUTTING-OUT ELEMENT AND CORRESPONDING CURSOR

(75) Inventors: Henri Bois, Neuilly sur Seine (FR); Antony Roger, Sartrouville (FR)

(73) Assignee: S2F Flexico, Henonville (FR)

( * ) Notice: Subject to any disclaimer, the term of this patent is extended or adjusted under 35 U.S.C. 154(b) by 361 days.

(21) Appl. No.: 12/734,587

(22) PCT Filed: Nov. 4, 2008

(86) PCT No.: PCT/EP2008/064904

§ 371 (c)(1),
(2), (4) Date: Jul. 30, 2010

(87) PCT Pub. No.: WO2009/062858

PCT Pub. Date: May 22, 2009

(65) Prior Publication Data

US 2010/0294802 A1 Nov. 25, 2010

(30) Foreign Application Priority Data

Nov. 13, 2007 (FR) ..... 07 07961

(51) Int. Cl.
*B65D 33/16* (2006.01)
*A44B 1/04* (2006.01)
*A44B 19/00* (2006.01)

(52) U.S. Cl.
USPC ..... 383/64; 383/59; 24/399; 24/415; 24/585.12

(58) Field of Classification Search ..... 383/64, 383/59; 24/399, 400, 415, 585.12
See application file for complete search history.

(56) References Cited

U.S. PATENT DOCUMENTS

| | | | | |
|---|---|---|---|---|
| 5,836,057 | A * | 11/1998 | Machfud | 24/400 |
| 6,247,844 | B1 * | 6/2001 | Tomic et al. | 383/64 |
| 6,385,818 | B1 * | 5/2002 | Savicki, Sr. | 24/30.5 R |
| 6,526,632 | B1 * | 3/2003 | Blythe et al. | 24/400 |
| 7,025,503 | B2 * | 4/2006 | Plourde | 383/64 |
| 7,263,748 | B2 * | 9/2007 | Blythe | 24/415 |
| 7,269,883 | B2 * | 9/2007 | Savicki | 24/399 |
| 2004/0045134 | A1 | 3/2004 | Savicki | |
| 2004/0049896 | A1 * | 3/2004 | Savicki | 24/399 |
| 2005/0188511 | A1 | 9/2005 | Chaturvedi | |
| 2005/0207679 | A1 * | 9/2005 | Armstrong | 383/64 |
| 2007/0211968 | A1 * | 9/2007 | Barbier et al. | 383/64 |

FOREIGN PATENT DOCUMENTS

WO WO 02/076258 A1 10/2002

OTHER PUBLICATIONS

International Search Report issued in application No. PCT/EP2008/064904 on Mar. 25, 2009.
French Search Report issued in application No. FR 0707961 on Jun. 4, 2008.

* cited by examiner

*Primary Examiner* — Jes F Pascua
(74) *Attorney, Agent, or Firm* — Foley & Lardner LLP

(57) ABSTRACT

A sachet has a body, the inner space of which is notably delimited by two sheets forming its main walls, and which includes complementary closing profiles respectively attached on these sheets as well as a cursor for actuating the profiles upon closing and opening, which comprises two longitudinal flanks connected by a base, as well as a longitudinal sole which extends from the base between the flanks, in order to delimit two opening/closing channels of the profiles. The cursor includes, longitudinally, in the extension of the base, a jutting-out element which extends beyond the flanks. The jutting-out element is positioned on the side of the cursor which corresponds to a closing direction of the profiles.

2 Claims, 2 Drawing Sheets

SACHET WITH A CURSOR PROVIDED WITH A JUTTING-OUT ELEMENT AND CORRESPONDING CURSOR

The present invention relates to a sachet comprising a body, the inner space of which is notably delimited by two sheets forming its main walls, and which includes complementary closing profiles respectively attached on these sheets, as well as a cursor for actuating the profiles upon closing and opening.

An example of such a sachet is illustrated in the appended FIGS. 1 and 2 as a front view and a sectional view respectively.

This sachet 1, usually in plastic, includes two sheets 10 and 11 generally parallel to each other in the absence of products in the inner space E which they delimit.

In the exemplary embodiment illustrated herein, both of these sheets 10 and 11 consist of a same and single film which has been turned over itself and welded along its two parallel edges 110.

Other embodiments are of course possible, and notably the one in which the sheets 10 and 11 are two separate entities which are assembled on three sides in order to form the sachet.

Complementary profiles 2 and 3 are attached onto the inner faces (facing each other) of the sheets 10 and 11, parallel to each other and in the vicinity of the upper free edge, as this is well known.

These are complementary male/female profiles, here but these may also be profiles with hooks or other ones.

The profiles 2 and 3 are added to the sheets, for example by welding or bonding. In a non-illustrated alternative, these may be profiles made in the same material together with the sheets 10 and 11.

A cursor 4 is also illustrated, positioned on the sachet 1.

It is also visible, in transverse and longitudinal sectional views in FIGS. 4 and 5.

This cursor, preferably in plastic, essentially includes a base 40 forming its upper wall and two parallel flanks 41 and 42.

From the base 40, a longitudinal sole 43 which delimits two channels $C_1$ and $C_2$ for opening/closing the profiles 2 and 3, extends between both of these flanks.

The sole 43 extends from one end of the base 40, only on a portion of the longitudinal extension of the cursor.

It has a shape similar to the sole of a laundry iron, its most tapered end being located on the inner side of the cursor.

The base of the profiles 41 and 42 is provided with a rib 44; respectively 45, directed inwards.

Both possible displacement directions of the cursor which respectively correspond to the closing and opening of the profiles 2 and 3, are referenced by the arrows $F_1$ and $F_2$ in FIGS. 3 and 4.

FIG. 3 illustrates a situation in which the cursor 4 has been displaced in the direction $F_1$, in order to close the profiles.

Now, it is not possible to position this cursor completely in abutment against the edge 110 of the sachet—i.e. in direct contact with it—, because of the connection of the sheets 10 and 11 in this region. Indeed, they gradually converge towards each other so that they oppose resistance to displacement of the cursor.

This and the presence of the sole 43 cause the fact that at the bottom, in other words in the vicinity of the cursor, the profiles 2 and 3 cannot be assembled, which generates an aperture O opening onto the inner space E of the sachet.

External elements, notably dusts and other pollutants may be introduced through this aperture, which may have harmful consequences on the contents of the sachet.

SUMMARY

The present invention is directed to solving this problem, i.e. providing a sachet with a cursor which, when the latter is positioned in abutment and in the closing position at one end of the sachet, guarantees, if not a perfect seal, at least a barrier to undesirable external elements.

This is therefore a sachet comprising a body, the inner space of which is notably delimited by two sheets forming its main walls, bound at their edges and which includes complementary closing profiles respectively attached onto these sheets, as well as a cursor for actuating the profiles upon closing and opening, which comprises two longitudinal flanks connected by a base, as well as a longitudinal sole which extends from the base between the flanks in order to delimit two opening/closing channels of the profiles, an aperture extending between the profiles and at the bottom of the cursor when the latter is positioned in abutment in proximity to one of said edges, in the closing position of the profiles, characterized by the fact that said cursor includes, longitudinally, in the extension of said base, a jutting-out element which extends beyond said flanks, this element being positioned on the side of the cursor which corresponds to the closing direction of said profiles, so that said element is located above said aperture and conceals the access, when the cursor is in said abutment position.

Thus, in the abutment position mentioned above, said jutting-out element is located above the aforementioned aperture and conceals the access.

According to other advantageous and non-limiting features:

- said cursor and said jutting-out element form a same and single part;
- said cursor and said jutting-out element form two distinct parts, each of them bearing mutual cooperation means;
- said mutual cooperation means are snap-on means;
- the distinct part containing said jutting-out element also integrates a portion of the flanks and base of said cursor;
- said jutting-out element includes means for pulling said cursor.

BRIEF DESCRIPTION OF THE DRAWINGS

Other features and advantages of the present invention will become apparent upon reading the description which follows of a preferential embodiment. This description will be given with reference to the appended drawings wherein.

DETAILED DESCRIPTION

Figure 1:
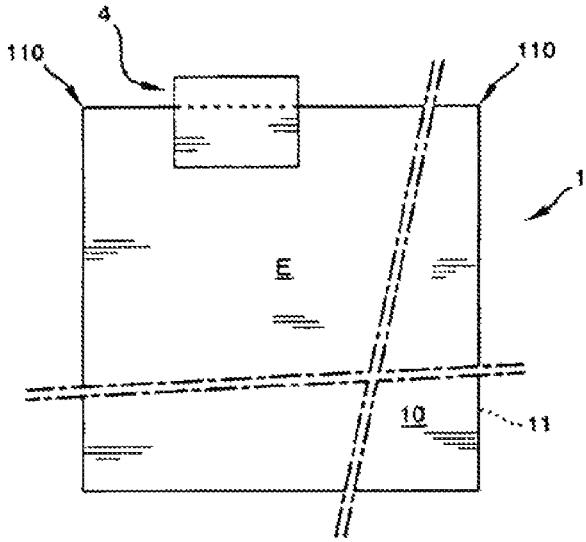
FIG. 1 PRIOR ART
FIGS. 1-5 represent, as already commented above, a sachet and a cursor according to the state of the art.
Figure 2:
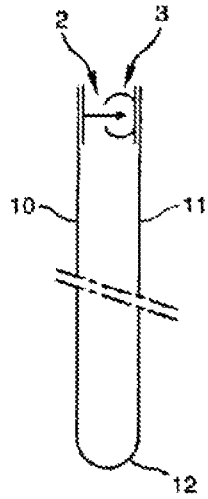
FIG. 2 PRIOR ART
Figure 3:
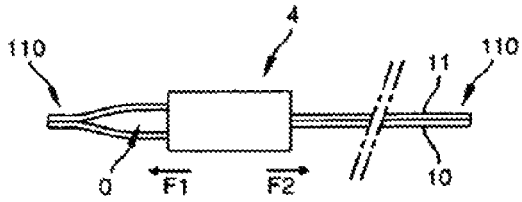
FIG. 3 PRIOR ART
Figure 4:
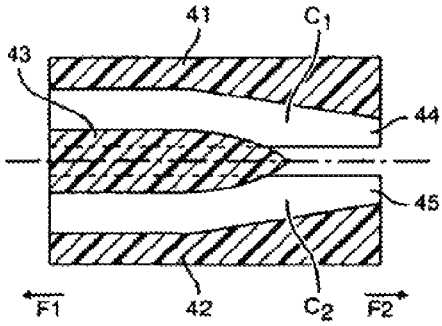
FIG. 4 PRIOR ART

According to the invention, the sachet of the invention, which may be of the same type as the one described with reference to FIGS. 1 and 2, is provided with a cursor 4 provided with a jutting-out element 5.

Figure 5:
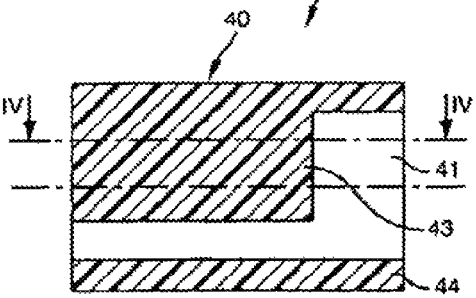
FIG. 5 PRIOR ART
Figure 6:
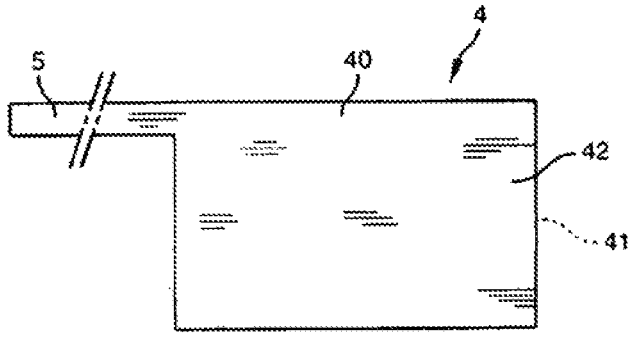
FIGS. 6-8 are side views of three embodiments of the cursor according to the invention.

More specifically, with reference to FIG. 5, the cursor 4 includes longitudinally in the extension of the base 40, a jutting-out element 5 which extends beyond the flanks 41 and 42, on the side of the cursor which corresponds to the closing direction of the profiles of the sachet.

In this case, this jutting-out element is positioned on the left portion of the cursor when FIGS. 1 and 5 are considered.

In this embodiment, the cursor 4 and element 5 form a single and unique part molded together.

The length of the element 5 is adapted to the size of the aperture O to be covered.

For example it is at least equal to the third of the length of the cursor.

Figure 7:
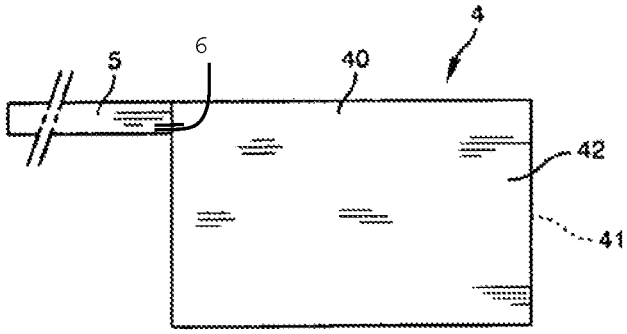

In the alternative of FIG. 7, the cursor 4 and the jutting-out element 5 form two distinct parts, each of them bearing mutual cooperating means 6.

As shown in FIG. 7, these are, for example, snap-on means of a known type.

Both of these parts may therefore be manufactured independently of each other and assembled before use.

Figure 8:
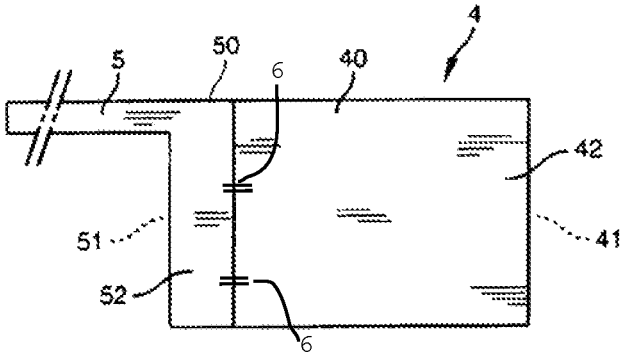

In the embodiment of FIG. 8, the cursor 4 and the jutting-out element 5 also form two distinct parts, and the latter also integrates a portion 51 and 52 of the flanks 41 and 42, as well as a portion of the base 40 of the cursor.

This structure improves mechanical strength of the element 5.

Figure 9:
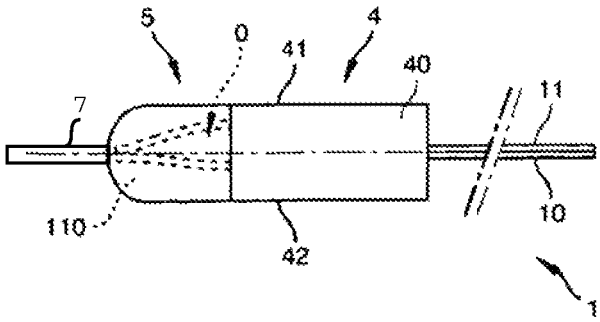
FIG. 9 is a partial top view of a sachet according to the invention, provided with its cursor having a jutting-out element.

In an embodiment shown in FIG. 9, the element 5 may be provided with means for pulling the cursor 4, such as a tab 7 molded therewith.

FIG. 9 shows the relative positioning of the jutting-out element 5 to the aperture O of the sachet 1.

Its shape and dimensions are of course adapted to the situation, so as to form a barrier, or to even form a real sealing means above the aperture O.

A same type of element 5, when it is provided as a distinct part, may be used, if necessary, in combination with several embodiments of the cursor 4.

The invention claimed is:

1. A sachet comprising a body, the body comprising:

two sheets forming main walls, the two sheets delimiting an inner space of the body, the two sheets being connected at their edges and including complementary closing profiles respectively attached on the two sheets, a cursor for actuating the profiles upon closing and opening, the cursor comprising two longitudinal flanks connected by a base, a longitudinal sole which extends from the base between the flanks in order to delimit two opening/closing channels of the profiles, an aperture extending between the profiles and at the base of the cursor when the cursor is positioned in abutment in proximity to one of the edges, in a closing position of the profiles, wherein the cursor includes longitudinally in an extension of the base, a jutting-out element which extends beyond the flanks, the jutting-out element being positioned on a side of the cursor which corresponds to a closing direction of the profiles, so that the jutting-out element is located above the aperture and conceals access when the cursor is positioned in abutment in proximity to the one of the edges, wherein the cursor and the jutting-out element form two distinct parts, each of the distinct parts bearing mutual cooperation means, the mutual cooperation means being snap-on means, and wherein the distinct part containing the jutting-out element integrates a portion of the flanks and the base of the cursor.

2. A sachet according to claim 1, wherein the jutting-out element includes means for pulling the cursor.

* * * * *